United States Patent [19]

Dickson

[11] Patent Number: 4,753,052

[45] Date of Patent: Jun. 28, 1988

[54] SURFACE BLASTING APPARATUS

[75] Inventor: Wayne E. Dickson, Tecumseh, Okla.

[73] Assignee: Dickson Industries, Inc., Tecumseh, Okla.

[21] Appl. No.: 23,490

[22] Filed: Mar. 2, 1987

Related U.S. Application Data

[63] Continuation-in-part of Ser. No. 729,466, May 1, 1985, Pat. No. 4,646,481, which is a continuation-in-part of Ser. No. 498,846, May 27, 1983, abandoned.

[51] Int. Cl.[4] ..... B24C 9/00

[52] U.S. Cl. ..... 51/424; 51/429; 51/432

[58] Field of Search ..... 51/424, 425, 429, 436, 51/431, 432, 434, 435, 437

[56] References Cited

U.S. PATENT DOCUMENTS

| | | | |
|---|---|---|---|
| 3,691,689 | 9/1972 | Goff | 51/424 |
| 3,756,377 | 9/1973 | Goff | 51/9 M X |
| 3,858,359 | 1/1975 | Leliaert | 51/425 |
| 3,877,175 | 4/1975 | Snyder | 51/425 |
| 3,900,969 | 8/1975 | Diehn . | |
| 3,934,373 | 1/1976 | Lelinert et al. | 51/425 |
| 3,977,128 | 8/1976 | Goff | 51/424 |
| 4,020,596 | 5/1977 | Bergh | 51/425 |
| 4,052,820 | 10/1977 | Bergh | 51/423 |
| 4,336,671 | 6/1982 | Nelson | 51/424 |
| 4,364,823 | 12/1982 | Goff | 51/429 X |
| 4,376,358 | 3/1983 | Shelton | 51/429 |
| 4,377,922 | 3/1983 | Bergh | 51/424 |
| 4,377,923 | 3/1983 | Bergh | 51/424 |
| 4,377,924 | 3/1983 | Bergh | 51/429 |
| 4,382,352 | 5/1983 | Nelson | 51/424 |
| 4,416,092 | 11/1983 | Nelson | 51/425 |
| 4,433,511 | 2/1984 | Swain | 51/429 X |

FOREIGN PATENT DOCUMENTS

| | | |
|---|---|---|
| 0032161 | 7/1981 | European Pat. Off. . |
| 2072549 | 10/1981 | United Kingdom . |

*Primary Examiner*—Debra Meislin

*Attorney, Agent, or Firm*—Laney, Dougherty, Hessin & Beavers

[57] ABSTRACT

A surface blasting apparatus including a wheel mounted chassis carrying a detachably mounted blasting head assembly. The blasting head assembly includes a housing enclosing a blasting wheel mounted for rotation about an axis extending parallel to a surface to be cleaned. The housing further includes a return chute through which abrasive returns after impacting such surface. A baffle assembly and magnetic arresting assembly cooperate to clean the abrasive particles by air washing. The air is then directed through a gravitating curtain of abrasive particles at a second cleaning location for further cleaning. The dust and debris laden air is then passed through a cyclonic separator and filtering system to clean the air prior to atmospheric discharge. Variously sized blasting head assemblies can be interchangeably mounted on the chassis for accomplishing various types of blast cleaning operations.

10 Claims, 6 Drawing Sheets

SURFACE BLASTING APPARATUS

This application is a continuation-in-part of U.S. patent application Ser. No. 729,466 filed on May 1, 1985, now U.S. Pat. No. 4,646,481, issued on Mar. 3, 1987, which is a continuation-in-part of U.S. patent application Ser. No. 498,846 filed on May 27, 1983, now abandoned. The details of both of those applications are incorporated herein by reference.

BACKGROUND OF THE INVENTION

1. Field of the Invention

This invention relates to surface cleaning equipment, and more particularly to a surface blasting apparatus which recovers substantially all of the blasting abrasive utilized in the blasting operation, and cleans that abrasive of debris which is picked up from the treated surface. The invention further relates to surface blasting apparatus having interchangeable blasting heads of varying width and/or containing variously configured blasting wheels to accommodate the apparatus to varying blasting requirements.

2. Brief Description of the Prior Art

Many types of blasting machines utilizing shot or other small abrasive particles for cleaning a surface, followed by recovery of the abrasive and debris from the treated surface, have heretofore been proposed, and several types of such machines have been placed in commercial use. Many of the machines separate the dirt and debris from the abrasive, so that the cleaned abrasive can be reused. Some of such surface blasting machines employ a mechanical pick-up system to pick up the abrasive from the treated surface, and then use a conveying system to carry the abrasive back to an abrasive storage hopper.

Different methods are employed in these blasting machines to clean the abrasive to permit its re-use without the necessity to frequently interrupt the surface blasting. One method involves the utilization of an air wash which entails the passage of a rapidly moving jet or stream of air through a falling curtain of abrasive so as to blow the dust and debris, which is relatively lighter than the abrasive, away from the abrasive, and collect it in an isolated location. Most systems of this type with which I am familiar do not provide adequate cleaning of the abrasive in that small and greasy particles of debris still continue to adhere to, and build up on, the abrasive. Frequent machine stoppage to manually clean the abrasive is therefore still required.

Another problem which is characteristic of many types of air blast cleaning systems is that the air which is used to clean up the abrasive particles is discharged from the machine is a condition in which it still contains an undesirable amount of dust, thus contaminating the environment, and endangering the health and well being of the operator of the machine, as well as passers-by or onlookers.

Surface blasting machines which employ abrasive particles propelled against the surface to be cleaned by a rapidly rotating blasting head have also lacked optimum flexibility in terms of the utilization of a single machine where there are different requirements of blasting area, blasting depth and/or speed of blasting encountered from one job to another. Thus, a particular machine may be ideal for blasting a very narrow band along a highway, such as that which is developed when a thin line or stripe, such as a center line or lane stripe, is removed, but it may be inadequate for rapidly abrading a bridge deck, or the total transverse width of a highway, at a rate which is competitive with some other types of blasting machines. The narrow blasting head which delivers optimum performance in removing stripes or painted bands is not adequate to permit a rapid speed of advance where the machine is to abrade a larger area of surface. Instead, it is often necessary to use two different types of machines for these two different types of job requirements, and an operator or contractor may be undesirably delayed in changing machines for the different job requirements. In some instances, both types of machines as needed for both of these kinds of jobs may not be readily available to the contractor.

Another problem which is encountered during the use of some types of surface blasting apparatus occurs where a relatively narrowly dimensioned blasting head is employed to remove the median stripe or lane lines from a highway surface. This problem is the propensity of machines presently available to trench or groove the highway during the stripe removal procedure. This result occurs because the relatively narrow blasting head channels and directs the abrasive particles into a highly concentrated, relatively small transverse width dimension, and the high concentration of high velocity abrasive particles develops a gouging or digging action which leaves an undesirable depression at the location where the stripe or lane line previously existed but has now been removed.

Some of the machines of the type described which have previously been proposed are depicted in U.S. Pat. No. 4,376,358 to Shelton, U.S. Pat. No. 4,382,352 to Nelson, U.S. Pat. No. 4,020,596 to Bergh, U.S. Pat. No. 4,416,092 to Nelson, U.S. Pat. No. 4,364,823 to Goff, U.S. Pat. No. 4,433,511 to Swain, U.S. Pat. No. 3,691,689 to Goff, U.S. Pat. No. 3,900,969 to Diehn, U.S. Pat. No. 3,877,175 to Snyder, U.S. Pat. No. 3,934,373 to Leliaert, U.S. Pat. No. 4,364,823 to Bergh, U.S. Pat. No. 4,336,671 to Nelson, U.S. Pat. No. 3,858,359 to Leliaert, U.S. Pat. No. 4,052,820 to Bergh, U.S. Pat. No. 4,377,924 to Bergh, U.S. Pat. No. 3,977,128 to Goff, U.S. Pat. No. 3,756,377 to Goff, U.S. Pat. No. 4,377,922 to Bergh, United Kingdom Patent Application No. 2,072,549, European Patent Application No. 0,032,161 and U.S. Pat. No. 4,377,923 to Bergh.

The surface blasting apparatus of the present invention provides a means for adequately air cleaning the abrasive particles, and for filtering the dust and debris from the cleaning air stream before discharging it to the atmosphere. The apparatus also offers a very versatile, utilitarian machine which, by the use of interchangeable blasting heads mounted on a common framework, can be used to meet varying specialized usage requirements, such as removing a narrow stripe from a highway or parking lot surface, or blasting a much wider path in a relatively high speed fashion to permit a large surface area to be cleaned in a short period of time. The apparatus also permits a narrow stripe to be removed from the highway without grooving the highway excessively during such removal.

BRIEF DESCRIPTION OF THE PRESENT INVENTION

The surface blasting apparatus of the present invention includes a blasting head assembly housing in which a blasting wheel is mounted and functions, from its mounted location, to propel abrasive particles at a high speed against a surface to be cleaned. The blasting wheel utilized in the apparatus includes a plurality of transversely extending batting bars or blades which are oriented to cause the abrasive particles to be uniformly directed against the surface to be cleaned along an even transverse line with a uniform distribution of particles along this line. This assures uniformity in the degree of abrasion over the abraded area on the surface.

The surface blasting apparatus further includes a return chute which forms a part of the blasting head assembly, and which receives rebounding abrasive particles after they have impacted the surface to be cleaned. At the upper, forward end of this chute, which is inclined to the vertical, a magnetic receiving means is provided and positioned across the axis of abrasive particle movement upwardly and forwardly in the return chute for receiving abrasive particles rebounded from the treated surface, and for removing substantially all of the kinetic energy therefrom as the abrasive impinges upon the magnetic receiving means and is arrested in its movement.

The apparatus further includes a baffle system positioned immediately adjacent the magnetic receiving means, but offset to one side of said axis of abrasive particle movement, and cooperating with the magnetic receiving means to cause air drawn through an opening at the lower end of the blasting head and up the return chute to wash over the abrasive particles as they are arrested in their movement by the magnetic receiving means, and to thus provide a first stage cleaning operation on the abrasive particles. The air flows sinuously through the baffle means, leaving the abrasive particles behind in the upper, forward end of the return chute as a result of their impingement upon the magnetic receiving means. Means is provided in the apparatus to develop a strong vacuum to draw air in through a relatively small slot at the trailing side of the blasting head assembly housing, so that the air current carries the abrasive particles upwardly to the magnetic receiving means before the air passes through the baffle system. The same current of air subsequently passes through a falling curtain of the abrasive particles after they have been recycled to a point above the blasting head assembly, and are falling down toward a storage hopper or container located over the blasting head. The air current, in passing through this falling curtain, develops a second stage cleaning action which thoroughly cleans the abrasive to remove any small particles of debris or dust which remain therein at this point.

The apparatus also includes means for removing from the air, heavy foreign debris picked up by the abrasive from the treated surface, and a heavy dust removing means which, in a preferred embodiment of the invention, is in the form of a pre-filter. A fine dust removing means is also provided, and may also be in the form of a filter. An auger system is included in the blasting apparatus and provides a means by which the debris removed from the abrasive particles can be transferred, along with dust particles, to a common opening to facilitate removal of the dust and debris from the apparatus.

The main housing and chassis of the apparatus are adapted to permit blasting head assemblies of various transverse sizes to be quickly and interchangeably mounted thereon in an effective blasting location. Thus, if the requirements for several blasting jobs vary, and in one case are best served by the use of a relatively narrow blasting head, such a head can be very quickly placed on the housing and chassis in place of a larger blasting head to deliver a concentrated flow of abrasive to a relatively narrow band along the surface to be blasted. This head can quickly be changed out for a relatively larger head if the subsequent job to be performed with the apparatus requires cleaning of a larger surface area in a rapid manner.

The machine of the invention further contemplates the selective variation, within a particular blasting head, of the effective length of the blasting wheel which is utilized, so that the abrasive directed against the surface will feather out in a way which does not cause an abrupt trench, groove or well defined channel to be formed when the machine is used to blast along a relatively narrow line or lane marker.

The blasting wheel employed in the blasting apparatus employs a plurality of circumferentially-spaced, axially extending bars or blades located on the periphery of the blasting wheel, and functioning to propel particles of the abrasive in a substantially monoplanar sheet or curtain at substantially the same angle along a transverse blast line in the surface to be treated. This construction assures uniformity of cleaning along the entire path of abrasive contact with the surface, and is to be contrasted with many types of prior blasting machines in which the particles are not thrown uniformly against the surface due to the manner in which the blasting wheel is constructed.

An object of this invention is to provide a baffle means for allowing air to be passed through the baffle means while cooperating with a magnetic arresting means to prevent the abrasive from moving up through the baffle means. In this fashion, the baffle means and the magnetic arresting means interact to allow high velocity air to remove dust and debris from the abrasive particles after the particles have rebounded from the treated surface.

A further object of the invention is to provide an auger means for removing large debris from the abrasive particles, and for transferring such debris to a cleaning compartment.

Another object of the invention is to provide a means for thoroughly air cleaning at two cleaning stages abrasive particles flowing through a surface blasting machine, which machine uses these particles to abrade a surface. The air flow impinges upon the abrasive at two locations in the apparatus, and removes debris and particles of dirt and dust from the abrasive particles at both locations.

A further object of the invention is to effectively remove dust and debris from air utilized to air wash abrasive particles utilized in a surface blasting apparatus.

An additional object of the invention is to provide means for transferring all of the dust and debris removed from the abrasive and air stream to a single location in the apparatus so that the removal of dust and debris from this single location is facilitated.

A further object of the invention is to provide a surface blasting apparatus which is constructed so that variously sized blasting heads can be quickly and easily interchanged in their mounting upon the blasting machine housing and chassis, and thereby permit the blasting machine to be used quite effectively in performing differing blasting operations having varying requirements in the areas to be blasted, and in the speeds at which the blasting machine needs to be advanced to accomplish the cleaning operation in an acceptable time.

A further object of the invention is to provide an improved blasting head assembly for use in surface blasting machines employing abrasive particles, with such head being constructed so that the cleaning of the surface with the abrasive particles propelled from the head is accomplished in a way which does not deeply and abruptly groove the surface or cut it in an undesirable fashion to leave a groove or rut in the surface.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

FIG. 1 is a longitudinal sectional view through the center of a surface blasting apparatus constructed in accordance with the present invention. At a broken-away portion, FIG. 1 also illustrates a part of a vertically extending bucket conveyor used for returning abrasive particles to the upper portion of the apparatus preparatory to returning them to a blasting head forming a part of the apparatus.

Figure 17:
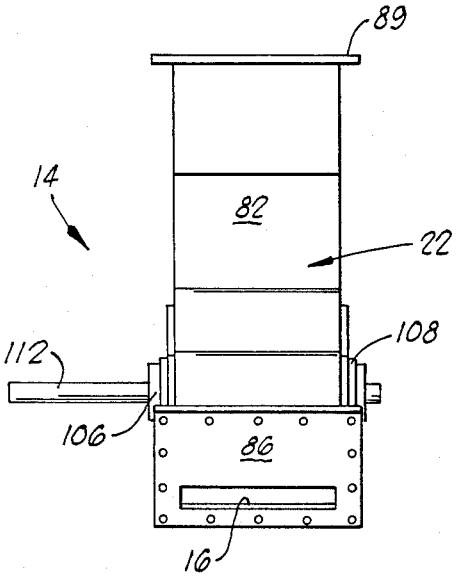
FIG. 17 is a top plan view of a blasting head assembly of one type which can be demountably positioned on the chassis of the surface blasting apparatus. The embodiment of the blasting head assembly shown in FIG. 17 is one which is adapted to blast a relatively broad abrasion pattern on a surface to be cleaned.
Figure 18:
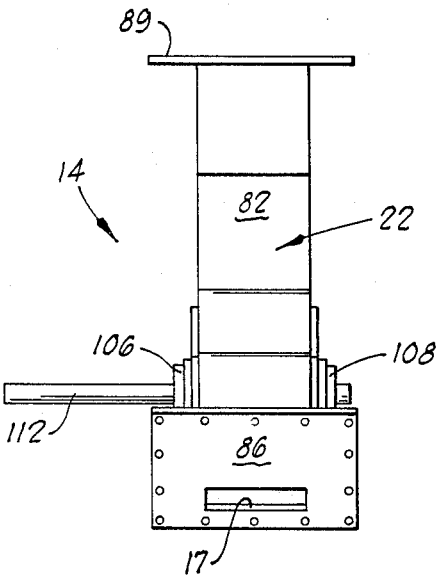

FIG. 18 is a modified or different embodiment of a blasting head assembly which blasts a narrower pattern than the blasting head assembly shown in FIG. 17, but which is mountable with equal facility and effect upon the chassis of the surface blasting apparatus of the invention without modification of the chassis or the housings carried thereon or the abrasive particle hopper which is used to feed abrasive to either selected one of the blasting head assemblies shown in FIGS. 17 and 18.

Figure 19:
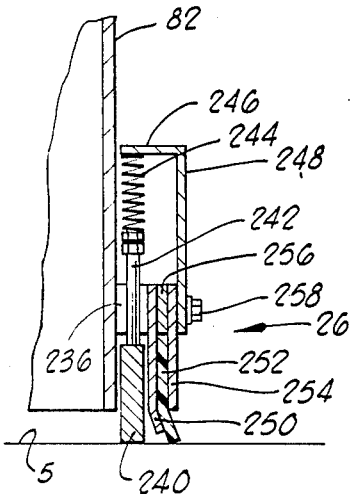

FIG. 19 is a sectional view taken along line 19—19 through a lateral seal assembly used at the side of the opening at the lower end of the blasting head assembly for the purpose of sealing against the surface to be cleaned, and thereby preventing the escape of abrasive particles.

Figure 20:
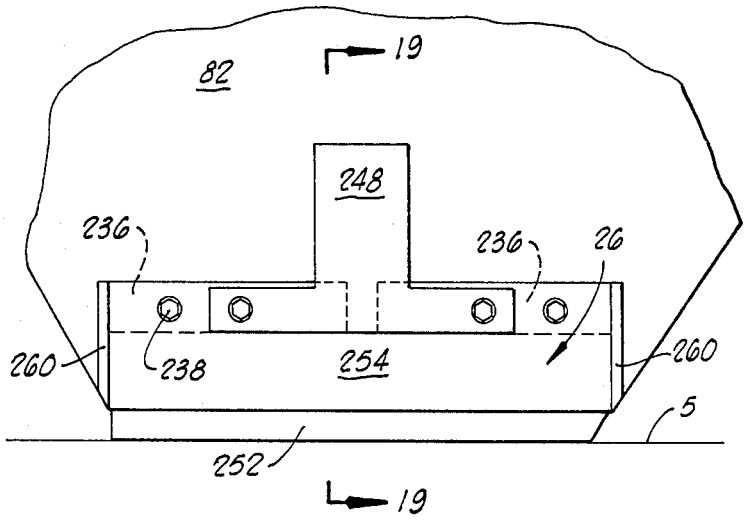

FIG. 20 is a side elevation view of the lateral seal used on the blasting head assembly to seal the side of the opening formed at the bottom of the blasting head assembly housing.

DETAILED DESCRIPTION OF THE PREFERRED EMBODIMENTS OF THE INVENTION

Figure 1:
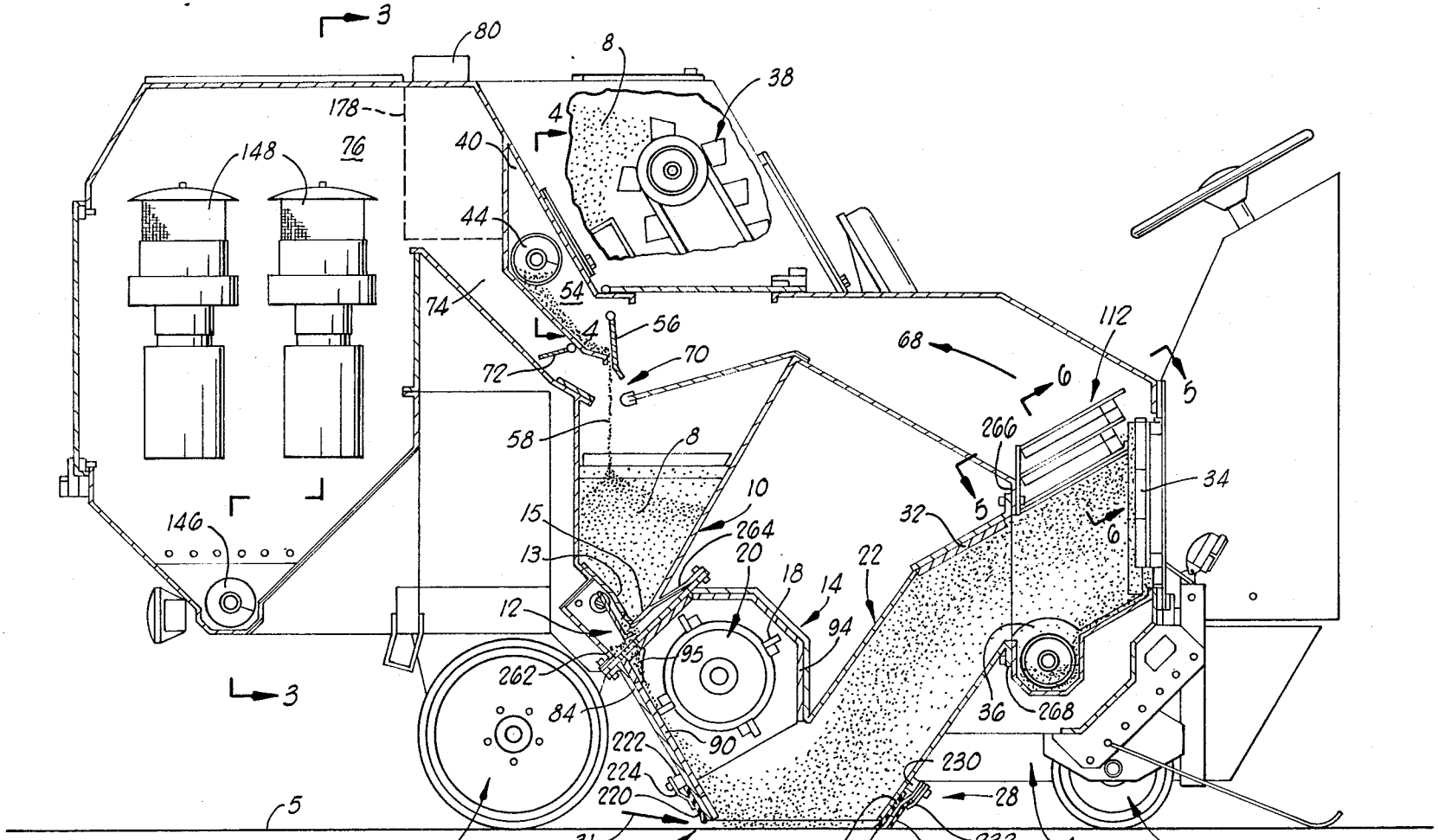

Referring now to the drawings, and particularly to FIG. 1, the surface blasting apparatus includes a chassis 4 supported by ground engaging wheels 6 on a surface 5 to be cleaned. Particulate abrasive material 8 is stored in a storage hopper 10 mounted on the chassis. The abrasive particles 8 can be steel shot or other fine, hard ferrous particles, such as steel grit. The particles pass through an opening 11 at the lower side of the storage hopper 10, which opening may be further restricted by means of a movable adjusting plate as hereinafter described. The abrasive particles are then fed by gravity through an abrasive flow control valve assembly 12 at the lower side of the storage hopper 10. The control valve assembly 12 is hereinafter explained in greater detail. The abrasive particles 8 are fed to a blasting head assembly denominated generally by reference numeral 14. The abrasive particles 8 pass through a slot 16 (see FIGS. 2 and 9) of selectively controlled width into the interior of the blasting head assembly 14, the structural details of which will be hereinafter described.

Figure 7:
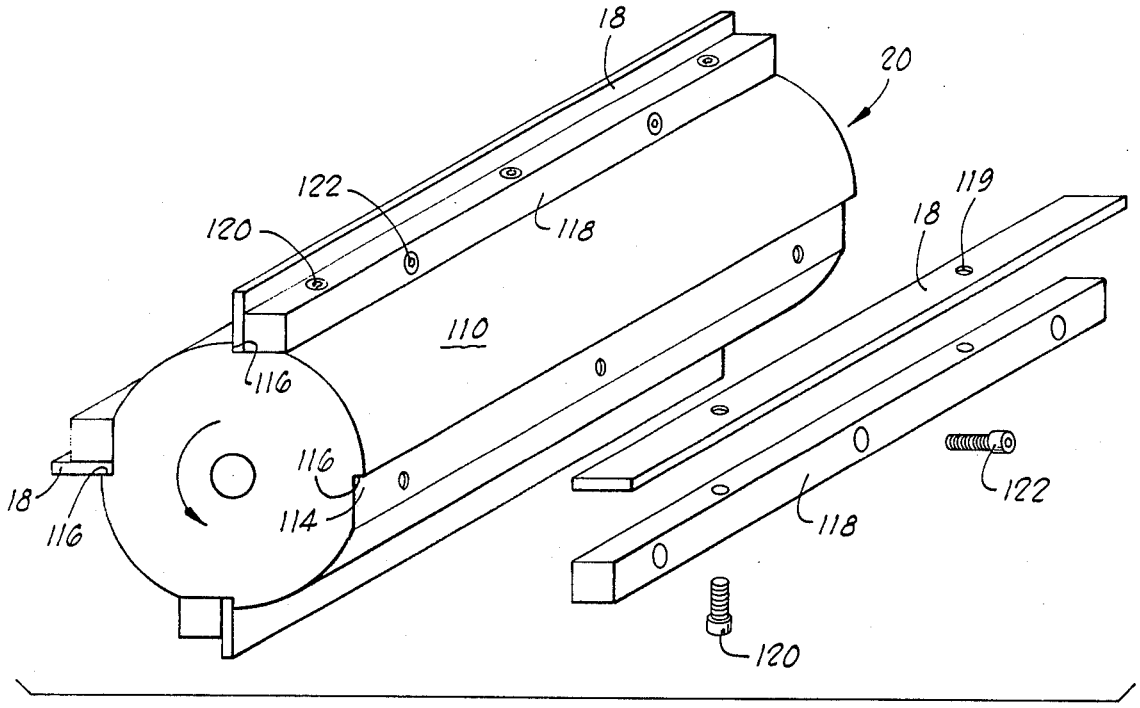
FIG. 7 is an exploded view illustrating a blasting wheel which is rotatably mounted in the blasting head housing of the present invention. The parts of the blasting wheel shown in this exploded view are illustrated in perspective.

Within the blasting head assembly 14, the abrasive particles 8 pass relatively close to the rear side of the blasting head housing and through the rotational path of movement swept out by hard, abrasion resistant batting blades 18 which are circumferentially spaced around the outer periphery of a blasting wheel 20. The structural details of the blasting wheel 20 are shown in FIG. 7 and will be subsequently described. The blades 18 of the blasting wheel 20 are moving at an angular velocity which substantially exceeds the velocity of the downwardly gravitating abrasive particles 8, so that the particles are batted by the blades 18 and accelerated to a high velocity. Typically, the blasting wheel rotates at from about 4000 to about 6000 RPM, and the particles are accelerated to about 250 feet per second.

The construction of the blasting wheel 20 and the manner in which the abrasive particles 8 are fed to it are such that the abrasive particles, moving at a high velocity, are directed downwardly in a slanting, generally monoplanar curtain which extends at an acute angle to the vertical, and the particles are substantially entirely positioned in a plane extending substantially parallel to the axis of rotation of the blasting wheel. This is an advantageous aspect of the present invention, for it assures that a uniform pattern of cleaning abrasion will be developed along a transversely extending line (transverse with respect to the abrasive blasting machine, and its direction of movement) across the surface to be blasted, rather than developing a greater degree of abrasion at some locations along the path of impact of the abrasive particles than at other points therealong, as has been undesirably characteristic of previously used surface blasting machines. The described transversely extending line of abrasive impact also extends parallel to the rotational axis of the blasting wheel.

Abrasive particles 8 rebound from the treated surface into the lower end of an abrasive return chute 22 forming a part of the blasting head assembly 14. For the purpose of preventing the escape of abrasive particles 8 from the blasting head assembly 14 as the particles rebound from the surface being cleaned, a plurality of seals 24, 26 and 28 are provided around the lower edge of the blasting head, and are in contact with the treated surface.

The seals 24, 26 and 28 are best illustrated in FIGS. 1, 2, 10, 19 and 20 of the drawings. At the rear side of the blasting head assembly 14 a relatively short seal 220 is secured to the back side of the blasting head assembly housing 82 by means of securing bolts 222 and a securing plate 224.

The forward seal assembly 28 includes a pair of elastomeric sealing flaps 226 and 228 which are retained in substantially parallel positions, and extend downwardly and rearwardly so that their lower edges engage the surface 5 to be cleaned. The elastomeric sealing flaps 226 and 228 are retained on the forward side of the blasting head assembly housing 82 by means of bolts 230 and a pair of parallel, rigid securing plates 232 and 234.

A pair of identical lateral or side seal assemblies 26 are provided at the opposite sides of the blasting head assembly housing 82, and the construction of one of these seals is best illustrated in FIGS. 19 and 20 of the drawings. Each seal assembly 28 includes a pair of horizontally spaced mounting bars 236, illustrated in dashed lines in FIG. 20, and partially depicted in FIG. 19. The mounting bars 236 are secured to the blasting head assembly housing 82 by means of a plurality of bolts (not visible) which are extended through openings in the mounting bars 236 into registering openings in the side of the blasting head assembly housing 82. The mounting bars 236 are spaced upwardly from the open lower edge of the housing 82 where it surrounds the opening at the bottom of the blasting head. The bars 236 are spaced upwardly by a sufficient distance to accommodate a floating seal plate 240 made of abrasion resistant metal.

A spring retainer stem 242 extends upwardly from the central portion of the floating seal plate 240 and passes between the mounting bars 236. At its upper end, the stem 242 has a pair of nuts 243 threaded thereon, and these nuts clamp between them, an end convolution of an elongated upwardly extending compression spring 244. A horizontally extending cap flange 246 of a spring retainer bracket 248 captures and serves as an abutment limiting movement of the top of the spring 244. The arrangement is such that the floating seal plate 240 can float upwardly upon encountering discontinuities in the surface being cleaned. In undergoing such upward movement, the seal plate 240 overcomes the resilient bias of the spring 244, but after passing the discontinuity is returned by the spring into sealing contact with the surface 5 to be cleaned.

The lateral seal assembly 26 further includes an inner seal retainer plate 250 which has an upper portion bolted to the spaced mounting bars 236. The lower end portion of the inner seal retainer plate 250 is angled outwardly to give direction and support to a rubber or resilient polyurethane outer seal flap 252. The seal flap 252 is clamped between the inner seal retainer plate 250 and a rigid outer seal retainer plate 254. The outer seal retainer plate 254 is clamped against a spacer bar 256 by bolts 258 extended through the spring retainer 248 and ultimately through the mounting bars 236 and into the housing 82. A pair of end seal plates 160 are provided at opposite ends of the floating seal assemblies 26, and are secured to, and project outwardly from, the blasting head assembly housing 82.

The floating seal assemblies 26 function effectively, and over a long service life, to prevent the escape of abrasive particles deflected outwardly by discontinuities in the surface being cleaned. Without the confining effect of the seal assembly 26, the particles could pass out of the blasting head assembly housing 82 in a lateral direction with respect to the path of movement of the surface blasting machine. Escape of particles in this way is dangerous to persons near the operating locus of the machine, and wasteful of the abrasive inventory.

The floating seal assembly 26 has a long service life in part by reason of the floating character of the solid abrasion resistant floating seal plate 240. Although the bottom of this abrasion resistant seal plate may wear away slowly as it rides over discontinuities in the surface to be cleaned, it will last somewhat longer than the flexible rubber or polyurethane seal flap 252. The latter seal can, however, be quickly and easily changed out, and a new seal flap placed in position whenever needed. Between the floating abrasion resistant seal plate 240 and the flexible seal flap 252, the high integrity of the seal assemblies is maintained at opposite sides of the blasting ahead assembly housing 82.

At the rear or trailing side of the lower opening into the housing of the blasting head assembly 14, the back wall of the blasting head assembly housing 82 terminates a small distance above the treated surface, as does the resilient seal flap 220 of the rear seal 24, to thus define an air ingress slot 30. A high velocity stream of cleaning air is drawn through the air ingress slot by a fan or suction apparatus provided within, and forming a part of, the blasting apparatus of the invention, and hereinafter described. The entering air stream is shown by the arrow 31 shown in FIGS. 1 and 2.

The abrasive return chute 22 is of substantially uniform cross-section, and extends upwardly and forwardly on the blasting machine. A deflector plate 32 at the exit portion of the chute 22 directs some of the abrasive particles horizontally and some downwardly toward a magnetic receiving and arresting means in the form of a plurality of vertically disposed magnets 34. Other particles moving along and below the central axis of the return chute 22 directly impinge upon the magnetic receiving and arresting means. Because the abrasive is ferro-magnetic, an envelope of abrasive particles 8 forms around the magnets 34. As the stream of abrasive particles 8 strikes the abrasive envelope, the particles are arrested and then fall downwardly, eventually coming to rest adjacent the lower abrasive auger 36.

The abrasive is moved by the auger 36 transversely with respect to the surface blasting apparatus and toward the lower end (not shown) of a bucket-type conveyor 38 of a kind known in the art, such as those which are generally illustrated in U.S. Pats. Nos. 4,336,671 to Nelson and 4,376,358 to Shelton. The abrasive particles 8 are carried upwardly by the conveyor 38 to a position above the hopper 10, and are discharged from the conveyor into an upper abrasive compartment 40.

Figure 4:
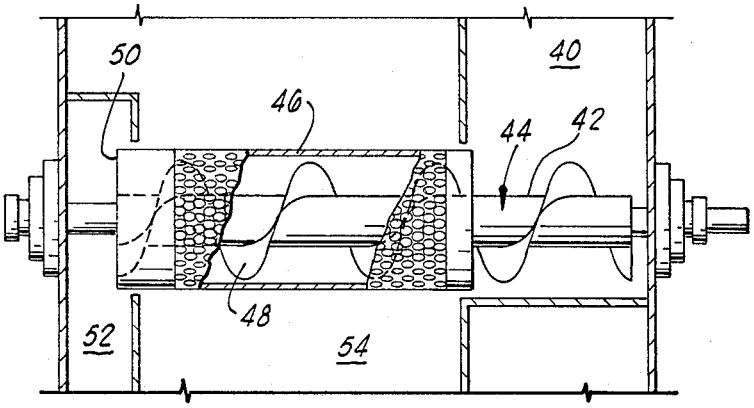
FIG. 4 is a view taken along line 4—4 of FIG. 1.

Referring to FIGS. 1 and 4, abrasive particles 8 fall downwardly in the compartment 40 toward an open end 42 of an upper abrasive auger 44. The abrasive particles 8 are then moved transversely by this auger 44 toward a filter screen 46 which encloses a second portion 48 of the auger 44. As viewed in FIG. 4, the abrasive moves to the left. Filter screen 46 includes a plurality of openings which are sized so that the abrasive particles fall through these openings. Large debris, however, such as foreign material picked up from the treated surface, or fragments from the treated surface, will not fall through these openings, but is instead moved further in a transverse direction by the auger, so as to fall from the open end 50 of the filter screen 46 into a large debris chute 52. As the abrasive falls through the openings in the filter screen 46, the abrasive enters the abrasive return chute 54 and continues downwardly toward the abrasive control valve 56. The abrasive control valve 56 is weighted, and when sufficient abrasive builds up in the abrasive return chute 54, the valve will automatically open and abrasive will be allowed to fall downwardly toward the hopper 10 forming a gravitating curtain 58 of the abrasive particles.

Figure 5:
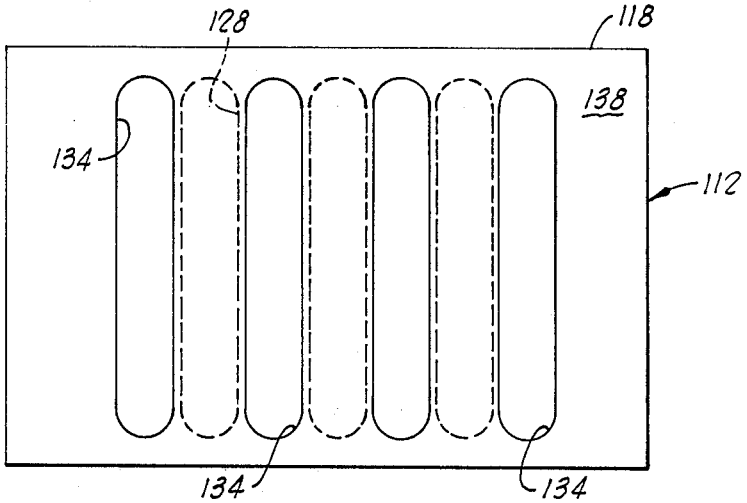
FIG. 5 is a view taken along line 5—5 of FIG. 1.
Figure 6:
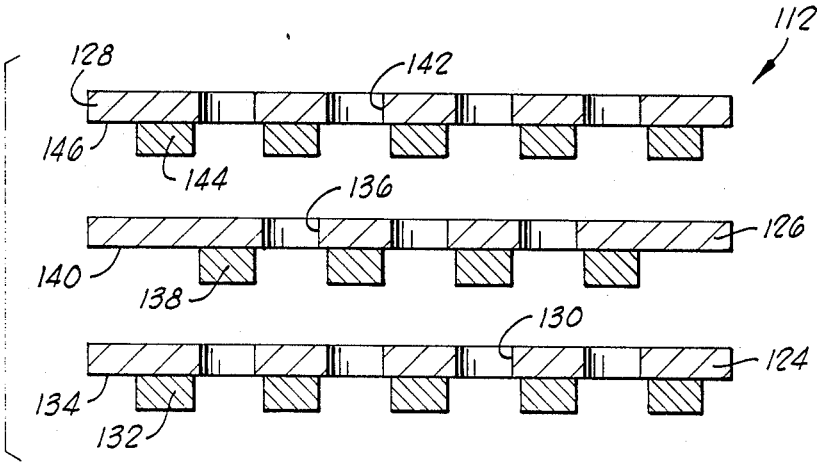
FIG. 6 is a sectional view taken along line 6—6 in FIG. 1, and illustrating the baffle assembly used in the present invention as the same appears in cross-section.

Referring still to FIG. 1, the air which is drawn into the lower end of the blasting head assembly 14 beneath the rear wall of the housing of that assembly, is indicated by the arrow 31 in FIG. 1. This air flows upwardly through the abrasive return chute 22 with abrasive particles 8 along an upwardly and forwardly extending axis of flow, and then passes upwardly through a baffle assembly which is designated generally by reference numeral 66, and is positioned to one side of this axis. The baffle assembly 66 is illustrated in structural detail in FIGS. 5 and 6.

After passing through the baffle assembly 66, the air moves along a circuitous path indicated by reference numeral 68 and ultimately arrives at a location, indicated by the arrow 70, where it is directed through the gravitating curtain 58 of abrasive. A second stage air wash is thus developed at this point, and the air further removes debris and dust from the abrasive particles 8, providing a secondary cleaning thereof. The flow of air and entrained debris is controlled by an air damper valve 72, and the air and debris move upwardly and rearwardly through the air duct 74 to enter a first cleaning chamber 76. Ultimately, the air is further cleaned by structural subassemblies hereinafter described prior to the time that it is discharged from the apparatus through the discharge opening 80.

THE ABRASIVE FLOW CONTROL VALVE

Figure 2:
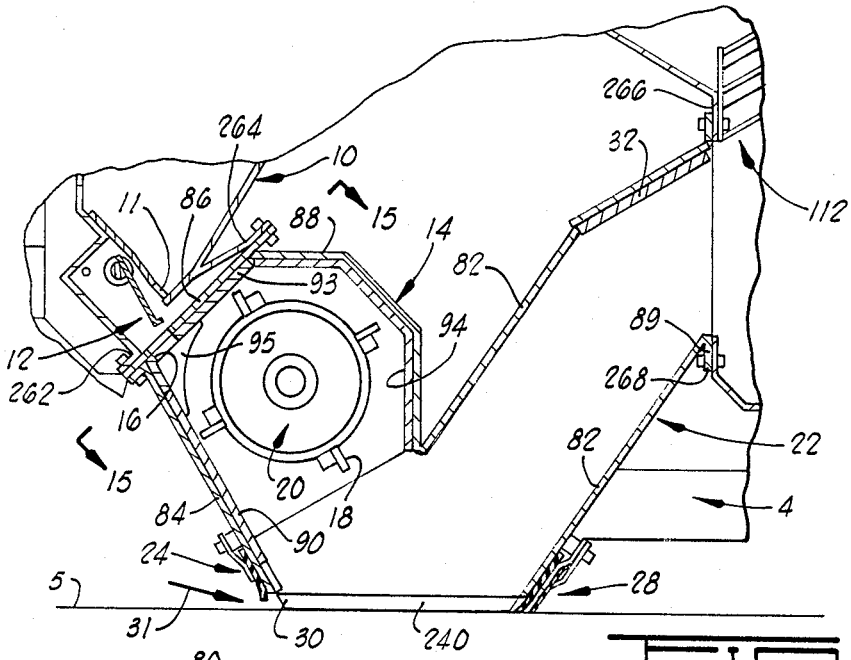
FIG. 2 is an enlarged side elevation view illustrating the manner in which a blasting head assembly is bolted to a housing forming a part of the blasting machine of the invention, with the blasting head housing, and the liners located internally thereof, being shown in section to illustrate a blasting wheel mounted within the blasting head housing.
Figure 8:
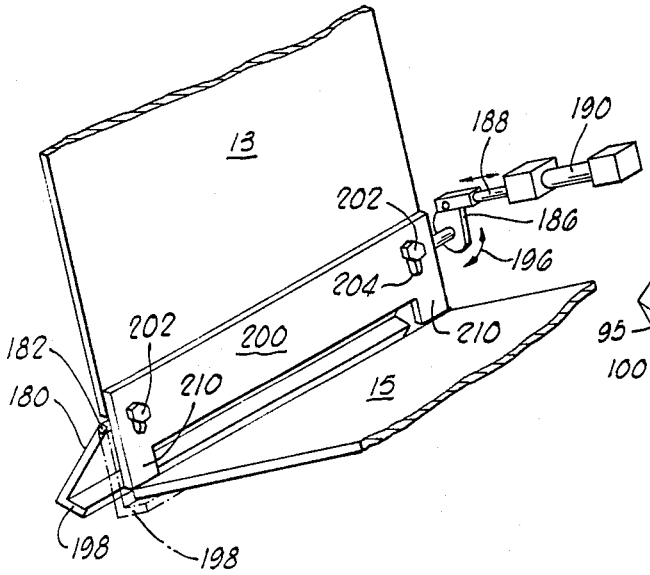
FIG. 8 is a partially elevational and partially sectional view of an abrasive flow control valve forming a part of the blasting machine, and used for controlling the flow of abrasive particles from an abrasive hopper to the blasting wheel located in the blasting head housing.

The abrasive storage compartment or hopper 10 is formed, in part, by slanted bottom walls 13 and 15 (see FIG. 8). At the lowermost portion of the abrasive storage compartment 10 the opening 11 is opened and closed by the abrasive flow control valve assembly 12. The abrasive flow control valve assembly 12 includes a substantially rectangular, elongated, flat primary or main plate 180 which is mounted to the rear wall 13 of the storage compartment by means of a horizontally extending hinge 182. The flow control valve assembly 12 is illustrated in FIGS. 1, 2 and 8 in the open position, and is shown in its closed position by means of phantom lines in FIG. 8.

Attached to the hinge 182 is an elongated shaft 184. To one end of this shaft, a control arm 186 is attached and is pivotally connected to a stem 188 which extends from a hydraulic cylinder 190. The stem 188 is reciprocated in a linear motion. As the stem 188 moves, it rotates the control arm 186 and the shaft 184 about the center line of the shaft. This rotary motion, indicated by the arrow 196, in turn rotates the abrasive flow control valve about the hinge 182 to open or close the control valve. Extending perpendicularly from the main plate 180 of the control valve assembly 12 is an elongated, horizontal sealing lip 198 which extends under and against a lower surface of the slanted wall 15 of the hopper 10 to form a seal preventing abrasive flow when the valve assembly is in its closed position. The size of the flow opening 11 can be selectively changed by means of a removable and replaceable, flow-opening adjusting plate 200 best illustrated in FIG. 8. Bolts 202 extend through slots 204 in the adjusting plate 200 and are threadedly engaged to the wall 13 of the hopper 10. The bolts 202 are tightened to hold the adjusting plate 200 in fixed, parallel contact with the wall 13. Adjusting plate 200 includes a downwardly extending leg 210 on each end thereof in contact with the wall 13. These legs 210 function to prevent abrasive from escaping along the ends of the control valve, and also their spacing determines the width of the abrasive curtain which will pass through the opening 11.

Figure 16:
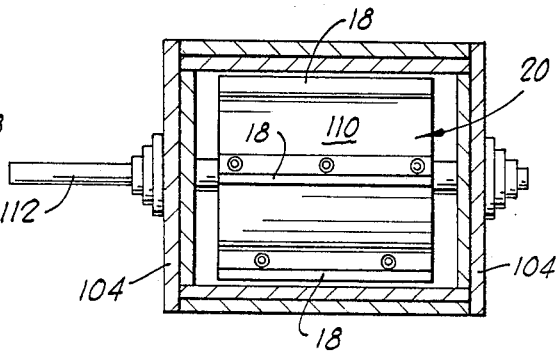
FIG. 16 is a sectional view similar to FIG. 15 illustrating the blasting head housing and the type of blasting wheel mounted therein for use with an upstream mounting plate of the type shown in FIG. 13 of the drawings.

Alternate embodiments of the removable and replacable adjusting plates 200 define varying distances separating the legs 210 which result in different horizontal widths of the opening 11, thereby providing selective abrasive flow rate and pattern control. As the horizontal width of the opening 11 is reduced, a narrower abrasive stream or curtain is fed to the blasting head assembly 14 in the manner hereinbefore described. This results in a horizontally narrower abrasive stream being directed from the blasting wheel toward and against the surface to be cleaned. When the blasting wheel 20 is constructed with relatively shorter blades 18, as is described below, and as is illustrated in FIG. 16 , the abrasive stream will spread horizontally so that it impacts the surface with a blast pattern of abrasive which is relatively heavy and slightly deeper at the center, and gradually lighter and shallower toward each end.

THE REMOVABLE BLASTING HEAD ASSEMBLY AND BLASTING WHEEL

Figure 9:
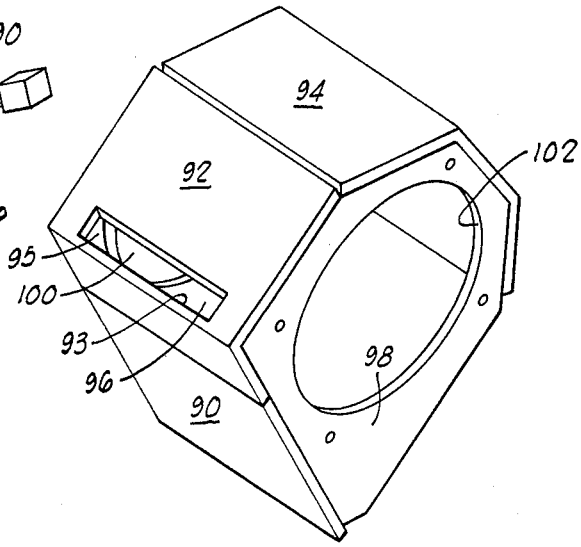
FIG. 9 is a perspective view of an assembly of liners which are utilized in, and form an internal portion of, the blasting head assembly used in the surface blasting apparatus of the invention.

The construction of the blasting head assembly 14 which forms a part of the surface blasting apparatus of the invention is best illustrated in FIGS. 2 and 9 of the drawings. The blasting head assembly 14 includes an external housing 82 which has a rear wall 84, a slotted blasting head mounting plate 86 and a top wall 88. The top wall 88 is bent through a pair of obtuse angles, each of approximately 135°. The bends are such that the upper part of the top wall 88 extends substantially horizontally, and the lowermost part of the top wall extends substantially vertically as illustrated in FIGS. 1 and 2.

Since the walls of the blasting head assembly housing 82 thus far identified define a chamber in which the blasting wheel 20 is mounted, this portion of this housing is provided with wear resistant liner plates which are illustrated in perspective and in isolation in FIG. 9. These liner plates are constructed of a high alloy, abrasion resistant metal, and are easily removable and replaceable within the housing 82. The liner plates are fitted within the described walls of the housing 82 as shown in FIG. 2. , and include a rear liner plate 90 which lines the lower portion of the housing rear wall 84. The liners also include an angulated and slotted shot admittance liner plate 92 which forms the internal lining of the blasting head mounting plate 86. It defines a slot 93 as shown in FIG. 9. A pair of parallel, abrasive channeling gusset plates 95 are disposed on opposite sides of the slot 93 and function to guide and channel abrasive particles into the path of blades 18. A forward angulated liner plate 94 having obtuse angular bends therein corresponding to the obtuse angles formed at the bends in the top wall 88 of the blasting head assembly housing 82 is utilized for lining the top as illustrated in FIGS. 2 and 9.

In addition to the described liner plates 90, 92 and 94, a pair of side or end face liner plates 96 and 98 are disposed at the opposite lateral sides of the blasting head assembly 14. The side face liner plates 96 and 98 are provided with central openings 100 and 102, respectively, which openings facilitate the mounting therein of the blasting wheel 20 (see FIGS. 1, 2 and 15). Closure plates 104 are mounted over the openings 100 and 102, in the manner illustrated in FIG. 10, and the blasting wheel 20 is supported in journals or bearings 106 and 108 in the manner illustrated in FIGS. 15 and 16.

Figure 15:
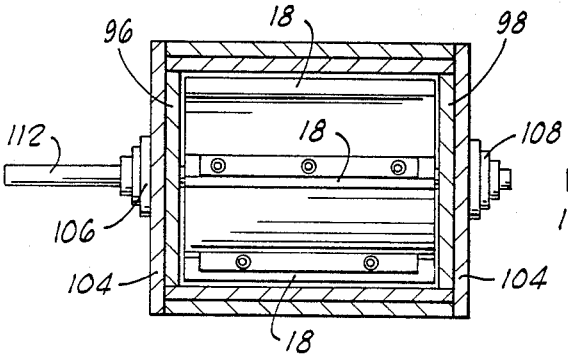
FIG. 15 is a sectional view taken along line 15—15 of FIG. 2 and illustrating, in section, the blasting head assembly housing, and a blasting wheel utilized with an upstream mounting plate of the type illustrated in FIG. 11.

The blasting wheel 20 is illustrated in detail in FIG. 7 of the drawings. The blasting wheel 20 includes a central drum or cylinder 110 which, as shown in FIGS. 15 and 16, is mounted on an elongated drive shaft 112 which projects through a bore formed in the center of the cylinder, and is connected to a kinematic chain (not shown) by which the cylinder is caused to undergo high speed rotation. As earlier described, the drive shaft 112 upon which the cylinder 110 of the blasting wheel is mounted extends through a pair of bearings or journals 106 and 108 so that the blasting wheel 20 is rotatably supported within the housing 82 of the blasting head assembly 14.

As illustrated in FIG. 7, the cylinder 110, in one embodiment, is notched or incut along chordal planes at four locations equidistantly spaced circumferentially around the cylinder, so as to form blade receiving grooves or notches 114 therein. In order to mount the blades 18 on the cylinder 110, the blades are placed in the notches 114 so that they bear against a shoulder 116 lying in a diametric plane of the cylinder 110. Each blade 18 is mounted in a locked or fixed position on the cylinder by placing a blade retaining or locking block 118 against a side of the blade and against the chordal surface of the notch or groove 114, and then extending a plurality of bolts 120 in a diametric direction through the locking block 118 and into the cylinder 110. A second group of bolts 122 is passed through the locking block 118 in a tangential direction with respect to the cylinder 110 so as to pass into receiving holes 119 formed in the blades 18 as illustrated in FIG. 7. It will be apparent that in other embodiments of the blasting wheel 20, additional notches 114 and a corresponding number of blades can be employed.

As shown by the arrow in FIG. 7, the cylinder 110 is rotated in a direction such that the batting blades 18 are the structural elements on the batting wheel to first contact the abrasive particles 8 which are gravitating downwardly within the external housing 82 of the blasting head assembly 14.

It will be noted that the blades 18 are mounted in a diametric plane extending through the cylinder 110, and extend from one end of the cylinder to the other substantially parallel to the axis of rotation of the cylinder. This axis of rotation in turn extends parallel to the surface to be cleaned. This is an important difference from the method of mounting the shot throwing vanes or blades in most prior types of blasting machines. Such prior method sets the cylinder axis of rotation to extend at an acute angle to the surface to be cleaned. Examples of this type of blasting wheel are to be found in U.S. Pat. No. 4,382,352 to Nelson, U.S. Pat. No. 3,977,128 to Goff and U.S. Pat. No. 3,934,373 to Leliaert.

These prior art types of machines tend to direct the shot unevenly against the surface to be cleaned as the particles of abrasive are slung off of the blades at varying velocities and from different points of departure. Most of these types of prior art blasting wheels are centrifugal wheels and feed the abrasive from the center of the wheel. Such wheels do not uniformly propel the particles along a line over which all of the shot contacted by the revolving blade 18 is hit substantially simultaneously, and has a substantially identical distance to pass from the blade to the surface which is being cleaned by impingement thereon of the shot particles.

Figure 11:
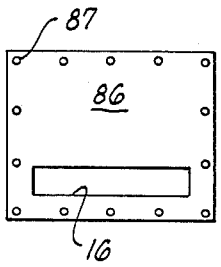
FIG. 11 is a view taken along line 11—11 of FIG. 10, and illustrating the slotted upstream mounting plate used for securing the blasting head assembly to the blasting machine housing by the use of a plurality of bolts.
Figure 10:
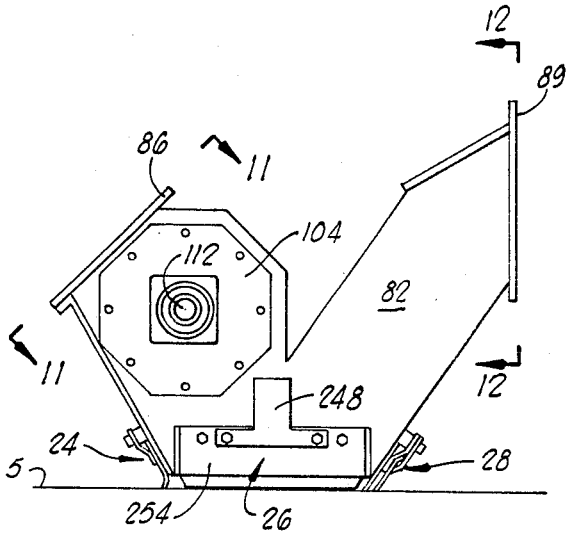
FIG. 10 is a view similar to FIG. 2, but illustrating, in elevation, one of the blasting heads detachably mountable on the chassis of the surface blasting apparatus of the invention, and illustrating one of the seals used for sealing around the opening at the lower side of the blasting head to prevent the escape of abrasive particles therefrom.
Figure 13:
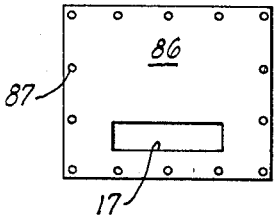
FIG. 13 is a view in elevation of a slotted upstream mounting plate similar to the mounting plate depicted in FIG. 11, but showing a mounting plate used in a modified embodiment of the invention which is especially adapted for use in blast cleaning a relatively narrow strip along a surface.

In referring to FIGS. 11, 13, 17 and 18 of the drawings, it will be noted that the blasting head assembly 14 can vary in its construction by variation in the configuration of the blasting head slotted upstream mounting plate 86. If FIGS. 11 and 13 are compared, it will be perceived that the slot 16 which is provided through the mounting plate 86 is different in each instance. The slot 17 in the mounting plate shown in FIG. 13 is relatively short in length as compared to the slot 16 shown in FIG. 11. The upstream mounting plate 86 of FIG. 11 closes the rear upper side of the blasting head assembly housing 82 when it contains a blasting wheel 20 constructed as shown in FIG. 15, and the slot 16 therethrough registers with an identically sized slot 93 in the liner plate 92(see FIG. 9). In referring to this figure, and comparing it with the blasting wheel shown in FIG. 16, it will be noted that the blades 18 project over almost the entire width of the blasting head and fill the space provided between the end face liner plates 96 and 98.

It will be perceived that when abrasive particles 8 are fed through the slot 16 provided in the mounting plate 86, and through the slot 93 provided in the liner plate 92, the particles enter the blasting head assembly housing 14 along a relatively long transverse line which corresponds substantially in length to the length of each of the blades 18. The particles entering the chamber where the wheel 20 is located are confined and channeled between the gusset plates 95 located at opposite ends of the slot 93. The result of this is that a concentrated curtain of descending particles, occupying a relatively wide zone, impinges upon the surface to be cleaned. Where the transverse width of the blasting head assembly 14 is relatively narrow, such as in the case of removing a plastic stripe from a highway, the abrasive material is concentrated uniformly over the width of that stripe and tends to form a trench or groove in place of the stripe as the paint or plastic which forms the stripe is removed from the pavement. This is an undesirable result which has been characteristic of many types of abrasive removing machines heretofore in use.

Where it is desirable to avoid this result, the blasting head mounting plate 86 of the type shown in FIG. 13 is utilized in conjunction with the blasting head and blasting wheel assembly shown in FIG. 16. Here the abrasive particles feed through a relatively narrow or short slot 17 to a blasting wheel 20 which carries blades 18 of a relatively shorter length, and which are in fact shorter than the transverse width of the housing between the end face liner plates 96 and 98. The particles will also pass through a relatively shorter slot than the slot 93 formed in the liner plate 92, and the liner plate 92 used in this modified embodiment will have the gusset plates 95 positioned substantially closer to each other. The result is that the abrasive particles 8 which are propelled against the surface to be cleaned by this blasting wheel tend to be fanned out more. Those abrasive particles which diverge from the ends of the blades 18 tend to be deflected off of the end face liner plates 96 and 98, and move through paths which reduce their velocity slightly as compared to those abrasive particles which originate directly from the blades 18, and pass in a straight line from each blade to the surface to be cleaned. The result of this fanning out action attained with the narrower slot configuration 17 shown in the mounting plate 86 of FIG. 13, and particularly and more specifically the shorter blades 18, is to reduce the severity of the trenching or grooving which tends to occur upon blasting away a painted line or plastic line marker on a highway. The abraded zone is feathered or smoothed out over the total transverse blasted area into a graduated feathering at the outer edges thereof.

The liner plates 90–98 utilized in the blasting head assembly 14 can be quickly and easily changed out as they become abraded and worn. Thus, it is not ordinarily necessary to replace, due to wear, the blasting head housing 82 over the entire life of the blasting machine. In addition to replacing the liner plates 90, 92, 94, 96 and 98 due to abrasive wear, the slotted liner plate 92 may be replaced simply to provide a narrower slot and a correspondingly shorter distance between the gusset plates 95. From the construction which has been described, it will be perceived that it is relatively easy, also, to switch or change out the particular blasting wheel 20 which is utilized, so as to obtain either the feathering surface removal effect which is achieved with a wheel of the configuration shown in FIG. 16 and utilizing the mounting plate 86 shown in FIG. 13, or to use a wheel with longer blades of the sort shown in FIG. 15, if that should be desired.

While discussing the blasting head assembly 14, a further important feature of the present invention should be pointed out. This is the ability, by reason of the way the chassis and housing of the surface blasting apparatus are constructed, to interchange blasting head assemblies 14 of varying transverse dimensions. The chassis 4 carries upstream mounting flanges 262 and 264 which are located adjacent the opening at the lower end of the abrasive particle hopper 10, and the chassis also carries downstream mounting flanges 266 and 268. These upstream and downstream mounting flanges 262, 264, 266 and 268 are best illustrated in FIGS. 1 and 2 of the drawings. The mounting flanges 262–268 carry a series of spaced bolt holes (not seen) which facilitate the bolting of variously sized blasting head assemblies 14 into operative position on the chassis at different times, and for different abrasive cleaning tasks. For this purpose, each of the blasting head assemblies 14 includes, as a part of its outer housing 82, the slotted upstream blasting head mounting plate 86 which defines a plurality of spaced bolt holes 87 therethrough. The bolt holes 87 in the plate 86 are positioned for registry with the bolt holes in the upstream mounting flanges 262 and 264 when the blasting head assembly 14 is bolted into operative position on the surface blasting machine.

Figure 12:
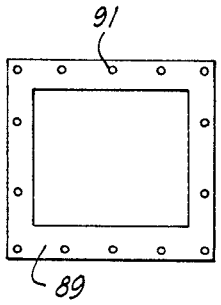
FIG. 12 is an elevation view taken along line 12—12 of FIG. 10, and illustrating a downstream mounting plate or flange used for securing the opposite side of the blasting head assembly to the housing of the surface blasting apparatus, utilizing a plurality of bolts for this purpose.
Figure 14:
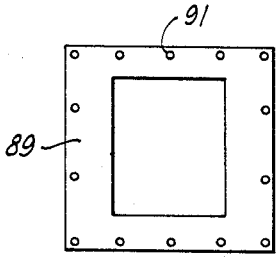
FIG. 14 is a view similar to FIG. 12, but showing a modified embodiment of the downstream mounting plate.

Each of the blasting head assemblies 14 also includes, on the downstream end of the external housing 82 thereof, a downstream mounting plate 89 which is carried at the discharge end of the abrasive return chute 22. The downstream mounting plate 89 defines a plurality of spaced bolt holes 91, as shown in FIGS. 12 and 14, which are positioned for registration with the bolt holes (not shown) in the downstream mounting flanges 266 and 268. The manner in which the upstream mounting flanges 262 and 264 abut the slotted upstream mounting plate 86, and the manner in which the downstream mounting flanges 266 and 268 abut the downstream mounting plate 89 is best illustrated in FIGS. 1 and 2 of the drawings.

The described construction permits variously sized blasting head assemblies 14 to be bolted into an operative position on the surface blasting machine. Two such differently sized blasting head assemblies 14 are illustrated in FIGS. 17 and 18 of the drawings. It will be noted that the larger blasting head assembly 14 depicted in FIG. 17 nevertheless includes exactly the same size slotted upstream mounting plate 86 as the corresponding upstream mounting plate 86 used on the smaller blasting head assembly shown in FIG. 18. The same is true of the two downstream mounting plates 89 carried by the blasting head assemblies shown in FIGS. 17 and 18. The size of blasting wheel carried in the interior of the blasting head assembly housing 82 shown in FIG. 18 is, however, substantially smaller than the blasting wheel used in the assembly shown in FIG. 17. The slots 16 and 17 through the upstream mounting plates 86 shown in FIGS. 17 and 18, respectively, also are different in their lengths, and in this way cause different amounts of abrasive to be fed to the interior of the blasting head assembly housing 82 over lines of feed of differing transverse width.

From this description, and the illustration of these two differently sized blasting head asemblies 14 as they appear in FIGS. 17 and 18, the possibility of selective variation in the sizes bolted into operative position on the surface blasting apparatus of the invention may be perceived.

As a result of the described interchangeability in the blasting head assemblies 14 used in the surface blasting apparatus of the invention, the abrasive particles 8 fed to the blasting head assembly through the slot 16 in the mounting plate 86 can, if desired, be charged to a relatively large blasting wheel 20 located within a relatively large blasting head assembly 14. In the blasting action achieved, the abrasive particles are spread over a wider transverse path as the machine advances. A relatively lighter abrading action is then achieved—that is, the depth of abrasion penetrating into the surface is relatively less—than where a machine with a narrower blasting head is utilized. In the latter case, the abrasive stream is more concentrated, and it is therefore easier to remove a thick coating plastic or synthetic resin or paint stripping material, even though the pace or speed of the machine, in terms of total surface area removed in a given amount of time, will be less than where the broad blasting head assembly is used.

It thus becomes possible for the owner of one surface blasting apparatus to effectively accomplish with this single machine, a variety of surface cleaning jobs having differing requirements. This could not be accomplished if it were not possible, from one job to another, to change out the blasting head assemblies used.

THE BAFFLE ASSEMBLY

As has been described, air drawn into the lower end of the return chute 22 passes under the rear wall of the blasting head assembly housing 82 and flows upwardly through the return chute 22 carrying rebounding abrasive particles. In the apparatus of the present invention, the strong current of air which is developed by a high capacity fan (subsequently described herein) tends to blow the abrasive particles up the return chute. It is important to understand that if this strong air current were terminated, the surface blasting apparatus would soon dump a major portion of its total abrasive inventory.

After the air with entrained abrasive particles passes by the deflector wear plate 32, the air passes upwardly through a baffle assembly 66 as has been hereinbefore described. The baffle assembly 66 is illustrated in detail in FIGS. 5 and 6 of the drawings. A preferred embodiment of the baffle assembly includes a lower baffle plate 124, a central baffle plate 126 and an upper baffle plate 128, but it will be understood by those skilled in the art that the number of baffle plates may be varied.

The lower baffle plate 124 defines a plurality of parallel, elongated slots 130 therethrough, and a preferred embodiment also has a plurality of parallel magnets 132 attached to a lower surface 134 thereof, and extending substantially parallel to the slots 130. The central baffle 126 also has a plurality of elongated slots 136 therethrough, and a plurality of parallel magnets 138 are preferably attached to the lower surface 140 thereof. Similarly, the upper baffle plate 128 has a plurality of slots 142 therethrough, and in a preferred embodiment of the invention, carries magnets 144 corresponding in number to the number of the slots 142. The magnets 144 are attached to the lower surface 146 so as to extend parallel to the slots. The slots 130 in the lower baffle 124 and the slots 142 in the upper baffle 128 are in substantially vertical alignment with each other, and the slots 136 in the central baffle plate 126 are staggered with respect to the slots 130 and 142. This causes air passing through the baffle to undergo an undulating movement through a sinuous path. Thus, any abrasive that might have a tendency to be carried upwardly with the flow of air which passes over the sinuous path through the baffle assembly 112 will be prevented from traversing the baffle assembly.

Upwardly moving particles 8 of abrasive which pass through the slots 130 in the lower baffle plates 124 predominantly impinge against the lower surface 140 of the central baffle plate 126, rather than passing through the slots 136. However, any abrasive that does pass through the slots 136 in the central baffle plate 126 should impinge upon, and be stopped by, the lower surface 146 of the upper baffle plate 128. In the magnet-carrying embodiment of the baffle assembly 112, upwardly carried abrasive particles moving toward the slots 130, 136 or 142 will most likely be attracted to, and stopped by, the respective magnets 132, 138 or 144. Thus, the baffle assembly 66 provides a passage for air flow that should prevent any appreciable upward movement of abrasive therethrough. The air which moves upwardly through the baffle assembly 66 will, however, carry dust and nonferrous light debris from the treated surface, after it has provided the first cleaning stage for the abrasive. As previously pointed out, abrasive which impinges upon the stacked magnets 34, and builds up an envelope of abrasive particles on these magnets, is thoroughly washed by the air rushing past the abrasive particles as the air enters the baffle assembly 66.

THE AIR CLEAN-UP SYSTEM

Figure 3:
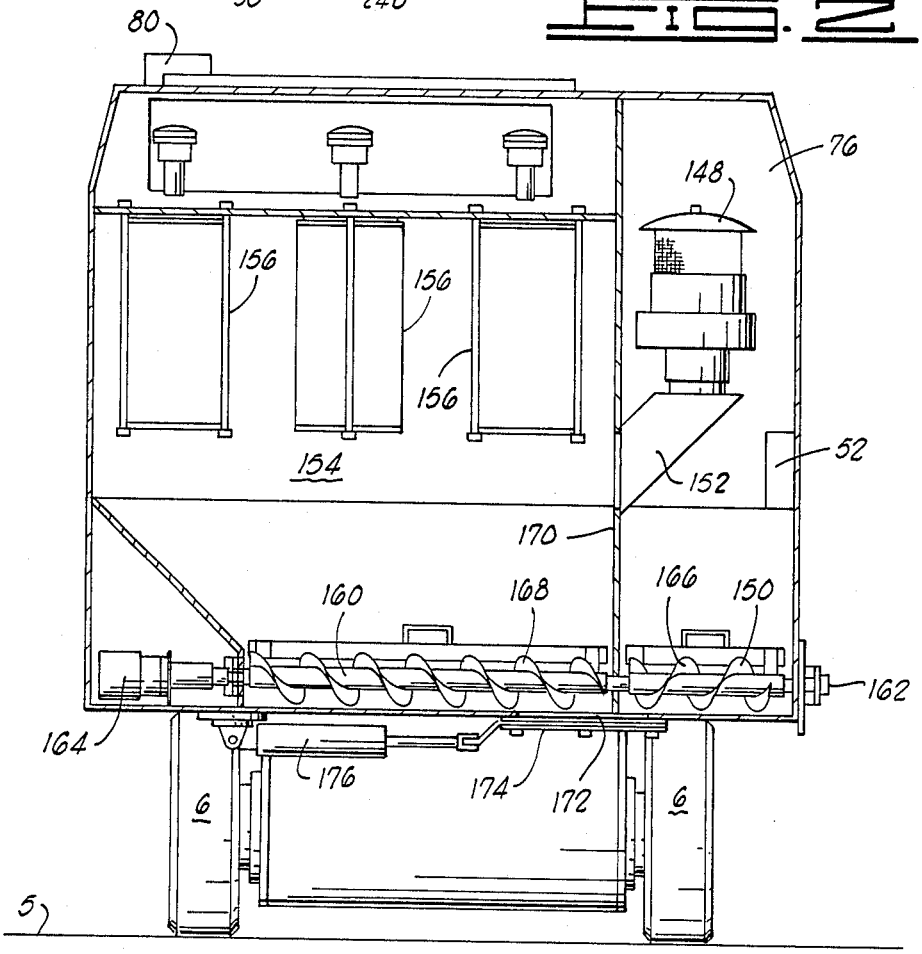
FIG. 3 is a partial cross-sectional view taken along line 3—3 of FIG. 1.

As shown in FIGS. 1 and 3, the air and debris in the first cleaning chamber 76 enters at least one pre-filter 148. In the preferred embodiment, two of the pre-filters 148 are provided and are cyclonic separators of the type shown in application Ser. No. 729,466, now U.S. Pat. No. 4,646,481. Heavy dust and debris is discharged from the prefilters 148 so that it falls downwardly toward a large debris auger 150 located in the bottom of the first cleaning chamber 76. The large debris chute 52 (see FIG. 4) also discharges into the first cleaning chamber 76 so that the large debris entering the chute from the filter screen 46 falls downwardly to the auger 150, along with the heavy dust from the pre-filter 148. The air, with some light dust still contained in it, is discharged from the first cleaning chamber 76 through a discharge conduit 152, and enters a second air cleaning chamber 154. The air and dust then flow through at least one filter 156 which removes substantially all of the remainder of the dust. Clean air is discharged from the apparatus through the discharge opening 80 as hereinbefore described. Dust removed from the air by the filters 156 falls downward toward the dust auger 160 located at the lowermost portion of the second air cleaning chamber 154.

It will be noted that the large debris auger 150 and the dust auger 160 are mounted on a common shaft 162 which is driven by a motor 164. The pitch of the blades 166 on the auger 150 is in the opposite direction from the pitch of the blades 168 on the auger 160. Thus, as the motor 164 turns the shaft 162, the augers 150 and 160 act cooperatively as an auger means by which the debris and dust are moved transversely in both the first and second cleaning chambers 76 and 154 toward a common divider wall 170 between the chambers. The innermost portions of the first cleaning chamber 76 and the second cleaning chamber 154 adjacent the divider wall 170 define a common opening 172 covered by a movable door 174 actuated by a hydraulic cylinder 176. The door 174 can be opened when it is desired to remove dust and debris from the first and second cleaning chambers through the common opening 172.

Air is continuously drawn through the abrasive return chute 22, the baffle assembly 66, the air duct 74, the first cleaning chamber 76, and the second cleaning chamber 154 by a high speed rotary fan 178 of a type known in the art and commercially available.

From the foregoing description of the invention, it can be perceived that the surface blasting apparatus of the present invention is well adapted to carry out and to achieve the objectives of the invention, and to attain the ends and advantages hereinbefore mentioned, as well as additional advantages inherent in the structure and mode of operation. While presently preferred embodiments of the invention have been described herein for the purpose of this disclosure, and to guide one skilled in the art in the use of the principles of the invention, numerous changes in the illustrated construction and described arrangement of parts can be made by those skilled in the art without departure from these principles. All such changes are encompassed within the spirit and scope of this invention as defined by the appended claims.

What is claimed is:

1. A surface blasting apparatus comprising:

a chassis having a front end, a rear end and opposite sides;

ground wheels rotatably mounted on said chassis;

an abrasive blasting head assembly detachably mounted on said chassis between said front end and rear end thereof for throwing abrasive particles at high velocity against a surface to be cleaned as the blasting apparatus is rolled thereacross on said ground wheels, said abrasive blasting head assembly comprising:

an abrasive blasting head assembly housing having:

a rear wall;

a first removable liner plate abutting said rear wall;

a slotted upstream mounting plate facilitating detachable partial mounting of said abrasive blasting head assembly housing on said chassis;

a second removable liner plate mounted within and abutting said slotted upstream mounting plate, and defining a slot aligned with the slot in said slotted upstream mounting plate for passing abrasive particles therethrough;

a top wall defining a pair of obtuse angles;

a third removable liner plate mounted within, and abutting, said top wall;

a first end plate means, including a first closure plate extending between said rear wall, upstream mounting plate and said top wall; and a second end plate means, including a second closure plate spaced from, and extending parallel to, said first end closure plate means, and extending between said rear wall, upstream mounting plate and said top wall; said first and second end plate means, rear wall, upstream mounting plate and top wall forming an open bottomed, lined, blasting wheel chamber within said abrasive blasting head assembly housing for accommodating an abrasive blasting wheel;

an abrasive return chute extending forwardly and upwardly from the open bottom of said blasting wheel chamber for receiving abrasive particles rebounding from said surface to be cleaned, said abrasive return chute having a first end adjacent the surface to be cleaned and having a discharge end, said chute defining an air and abrasive flow path extending generally in a line between said first end and said discharge end of the chute;

a downstream mounting plate on said abrasive return chute facilitating detachable partial mounting of said blasting head assembly on said chassis; and an abrasive particle blasting wheel rotatably mounted in said lined blasting wheel chamber within said blasting wheel assembly housing for rotation about an axis extending parallel to the plane of the surface to be cleaned when said ground wheels are rollably supported on said surface, said blasting wheel having its axis of rotation extending through said first and second spaced, parallel end plate means; and a first stage air-wash abrasive cleaning station mounted immediately forward of, and at the discharge end of, said abrasive return chute, which cleaning station includes:

a baffle assembly offset to one side of the substantially linear flow path of air and abrasive particles flowing upwardly and forwardly in said abrasive return chute to facilitate the movement of air away from the relatively heavier and more dense abrasive particles moving along said linear flow path by allowing the relatively lighter air to move upwardly through said baffle assembly; and magnets interposed in line with said substantially linear flow path to arrest and hold magnetic abrasive particles at a location adjacent said baffle assembly while air flows through the arrested magnetic abrasive particles before passing through said baffle assembly.

2. A surface blasting apparatus as defined in claim 1 and further characterized as including a pair of selectively spaced, channeling gusset plates disposed within said abrasive blasting head assembly housing, and on opposite sides of the slot in said upstream mounting plate for guiding and channeling abrasive particles passing through said slot into said housings.

3. A surface blasting apparatus as defined in claim 1 and further characterized as including a second stage air wash-abrasive cleaning station receiving air flowing from said baffle assembly, and positioned in the path of gravitating abrasive particles gravitating toward said blasting head assembly after being detached from said magnets.

4. A surface blasting apparatus as defined in claim 1 and further characterized as including:

an abrasive hopper having an upper end and a lower end defining an opening therethrough; and a flow control valve assembly mounted to the lower end of said abrasive hopper, and including means for selectively controlling the quantity of abrasive particles, and the pattern of abrasive particles, flowing from said hopper to said blasting head assembly.

5. A surface blasting apparatus as defined in claim 1 wherein said blasting wheel includes:

a cylinder rotatably mounted in said lined blasting wheel chamber; and blades secured to the outer periphery of said cylinder and extending parallel to the axis of rotation of said cylinder;

and wherein said apparatus further includes:

means for selectively feeding to said blades a controlled width curtain of abrasive particles of a width not greater than the length of said blades as measured in a direction parallel to the axis of rotation of said cylinder.

6. A surface blasting apparatus as defined in claim 2 and further characterized as including a second stage air wash-abrasive cleaning station receiving air flowing from said baffle assembly, and positioned in the path of gravitating abrasive particles gravitating toward said blasting head assembly after being detached from said magnets.

7. A surface blasting apparatus as defined in claim 2 and further characterized as including an abrasive hopper having an upper end and a lower end with an opening formed through said lower end; and a flow control valve assembly mounted on the lower end of said abrasive hopper, and including means for selectively controlling the quantity of abrasive particles, and the pattern of abrasive particles flowing from said hopper to said blasting head assembly.

8. A surface blasting apparatus as defined in claim 2 wherein said blasting wheel includes:

a cylinder rotatably mounted in said lined blasting wheel chamber; and blades secured to the outer periphery of said cylinder and extending parallel to the axis of rotation of said cylinder;

and wherein said apparatus further includes:

means for selectively feeding a controlled-width curtain of abrasive particles to said blades of a width not greater than the length of said blades as measured in a direction parallel to the axis of rotation of said cylinder, said means including, as a part thereof, said pair of spaced, channeling gusset plates.

9. A surface blasting apparatus as defined in claim 8 wherein said means for selectively feeding a controlled-width curtain of abrasive particles to said blades further includes:

an abrasive hopper having an upper end and a lower end defining an opening therethrough; and a flow control valve assembly mounted to the lower end of said abrasive hopper, and including means for selectively controlling the quantity of abrasive particles and the pattern of abrasive particles flowing from said hopper through said opening to said blasting head assembly and feeding abrasive between said spaced channeling gusset plates.

10. A surface blasting apparatus as defined in claim 9 and further characterized as including a second stage air wash-abrasive cleaning station receiving air flowing from said baffle assembly, and positioned in the path of gravitating abrasive particles gravitating toward said blasting head assembly after being detached from said magnets.

* * * * *